US006112899A

United States Patent [19]

Zeringue

[11] Patent Number: 6,112,899

[45] Date of Patent: Sep. 5, 2000

[54] LUNCH BOX SYSTEM

[76] Inventor: Florence S. Zeringue, 310 Ellen St., Ama, La. 70031

[21] Appl. No.: 09/294,670

[22] Filed: Apr. 19, 1999

[51] Int. Cl.[7] ..... B65D 81/38; A45C 11/20

[52] U.S. Cl. ..... 206/541; 206/549; 206/818

[58] Field of Search ..... 206/541, 542, 206/216, 223, 545, 549, 818; 220/23.91, 23.87, 23.83

[56] References Cited

U.S. PATENT DOCUMENTS

| | | | |
|---|---|---|---|
| 1,703,221 | 2/1929 | Bowles . | |
| 2,321,703 | 6/1943 | Rivard | 206/541 |
| 3,508,183 | 4/1970 | Pinckard | 206/818 |
| 3,610,409 | 10/1971 | Graf . | |
| 3,640,380 | 2/1972 | Huffman | 206/549 |
| 3,811,560 | 5/1974 | Schilling et al. . | |
| 3,871,523 | 3/1975 | Bassett . | |
| 4,648,512 | 3/1987 | Tarozzi et al. | 206/541 |
| 5,086,926 | 2/1992 | Paige et al. . | |
| 5,181,612 | 1/1993 | Liu . | |
| 5,390,797 | 2/1995 | Smalley et al. | 206/545 |
| 5,396,999 | 3/1995 | Sandheinrich | 206/818 |
| 5,505,307 | 4/1996 | Shink | 206/541 |

*Primary Examiner*—Paul T. Sewell
*Assistant Examiner*—Luan K. Bui
*Attorney, Agent, or Firm*—Joseph N. Breaux

[57] ABSTRACT

A lunch box system that includes an insulated compartment for storing and preserving food for consumption at a later time that includes a lid including a mechanism for retaining the food containers in place against forces such as wind.

1 Claim, 3 Drawing Sheets

LUNCH BOX SYSTEM

TECHNICAL FIELD

The present invention relates to lunch boxes and more particularly to a lunch box system that includes a lower insulated container structure having a pivoting handle assembly attached to the exterior thereof and a food storage compartment formed therein accessible through a top opening; an insulated lid assembly including a bottom portion sized to friction fit into and seal the top opening of the lower insulated container structure, a pull out drink holder, a pair of ice pack gripping ridges depending from an underside surface thereof, and a container retaining recess formed into a top lid surface thereof, the retaining recess having a magnetic retaining structure provided therein; a refreezable ice pack shaped, sized and provided with gripping ridge receiving channels along opposed side edges thereof such that the refreezable ice pack is slidable into engagement with the ice pack gripping ridges of the insulated lid assembly; and a container having a bottom surface provided with a material to form a magnetic connection with the magnetic retaining structure of the retaining recess such that the container is held in place against a force such as blowing wind etc.

BACKGROUND ART

It is often desirable to have lunch at a remote location under conditions where the elements such as wind can make it difficult for the food containers to remain in place. It would be desirable, therefore, to have a lunch box system that includes an insulated compartment for storing and preserving food for consumption at a later time that includes a lid including a mechanism for retaining the food containers in place against forces such as wind.

GENERAL SUMMARY DISCUSSION OF INVENTION

It is thus an object of the invention to provide a lunch box system that includes a lower insulated container structure having a pivoting handle assembly attached to the exterior thereof and a food storage compartment formed therein accessible through a top opening; an insulated lid assembly including a bottom portion sized to friction fit into and seal the top opening of the lower insulated container structure, a pull out drink holder, a pair of ice pack gripping ridges depending from an underside surface thereof, and a container retaining recess formed into a top lid surface thereof, the retaining recess having a magnetic retaining structure provided therein; a refreezable ice pack shaped, sized and provided with gripping ridge receiving channels along opposed side edges thereof such that the refreezable ice pack is slidable into engagement with the ice pack gripping ridges of the insulated lid assembly; and a container having a bottom surface provided with a material to form a magnetic connection with the magnetic retaining structure of the retaining recess such that the container is held in place against a force such as blowing wind etc.

Accordingly, a lunch box system is provided. The lunch box system includes a lower insulated container structure having a pivoting handle assembly attached to the exterior thereof and a food storage compartment formed therein accessible through a top opening; an insulated lid assembly including a bottom portion sized to friction fit into and seal the top opening of the lower insulated container structure, a pull out drink holder, a pair of ice pack gripping ridges depending from an underside surface thereof, and a container retaining recess formed into a top lid surface thereof, the retaining recess having a magnetic retaining structure provided therein; a refreezable ice pack shaped, sized and provided with gripping ridge receiving channels along opposed side edges thereof such that the refreezable ice pack is slidable into engagement with the ice pack gripping ridges of the insulated lid assembly; and a container having a bottom surface provided with a material to form a magnetic connection with the magnetic retaining structure of the retaining recess such that the container is held in place against a force such as blowing wind etc.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
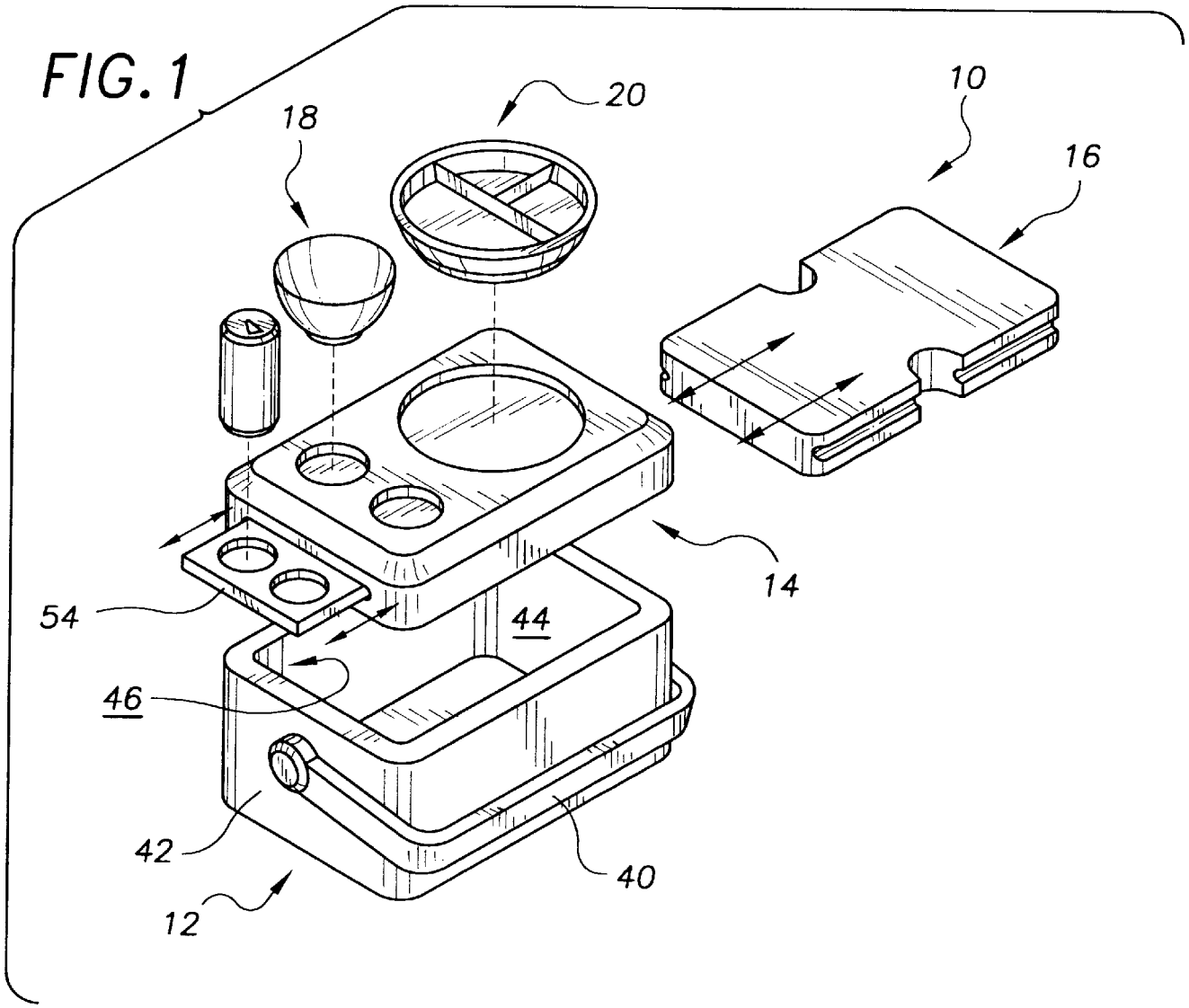
FIG. 1 is an exploded perspective view of an exemplary embodiment of the lunch box system of the present invention showing the lower insulated container structure having a pivoting handle assembly attached to the exterior thereof and a food storage compartment formed therein accessible through a top opening; an insulated lid assembly including a bottom portion sized to friction fit into and seal the top opening of the lower insulated container structure, a pull out drink holder, a pair of ice pack gripping ridges depending from an underside surface thereof, and a number of container retaining recesses formed into a top lid surface thereof, at least one retaining recess having a magnetic retaining structure provided therein; a refreezable ice pack shaped, sized and provided with gripping ridge receiving channels along opposed side edges thereof such that the refreezable ice pack is slidable into engagement with the ice pack gripping ridges of the insulated lid assembly; and a container having a bottom surface provided with a material to form a magnetic connection with the magnetic retaining structure of the retaining recess such that the container is held in place against a force such as blowing wind etc.
Figure 2:
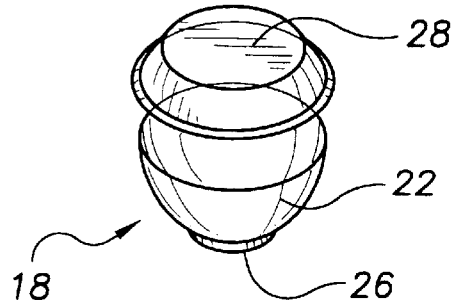
FIG. 2 is an exploded view of an exemplary sealable container having a bowl shape with a magnetically attractable bottom and a snap on lid.
Figure 3:
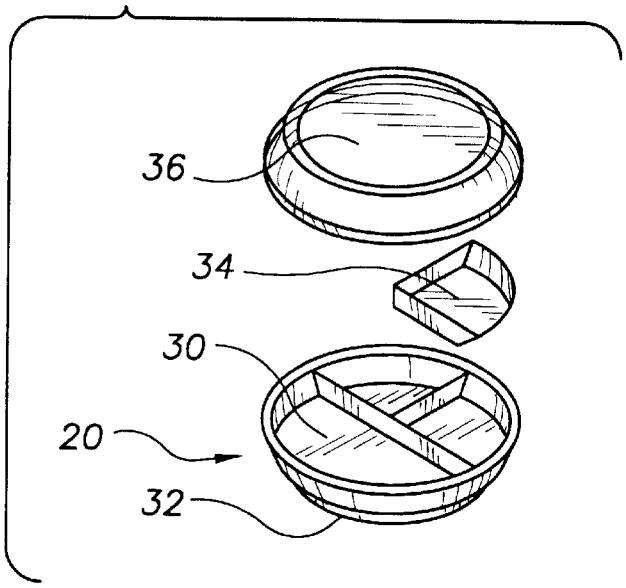
FIG. 3 is an exploded view of a second exemplary sealable container having a multiple compartment plate with a magnetically attractable bottom, a removable insert and a snap on lid.
Figure 4:
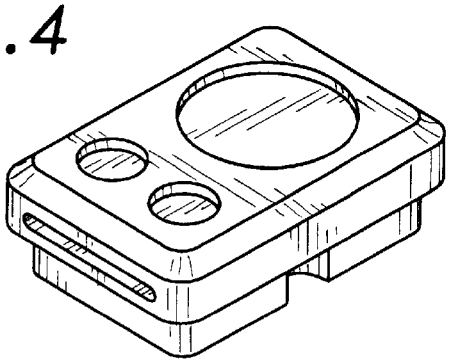
FIG. 4 is a detail perspective view of the lid assembly in isolation with the refreezable ice pack in engagement with the insulated lid assembly.

FIG. 1 is an exploded view of an exemplary embodiment of the lunch box system of the present invention, generally designated 10. Lunch box system 10 includes a lower insulated container structure, generally designated 12; an insulated lid assembly, generally designated 14; a refreezable ice pack, generally designated 16; and two sealable containers, generally designated respectively 18,20 (se also FIGS. 2 and 3). Referring to FIG. 2, sealable container 18 includes a plastic bowl shaped bottom structure 22 with a magnetically attractable steel bottom 26 and a snap on plastic sealing lid 28. Referring to FIG. 3, sealable container 20 includes a multiple compartment plastic plate 30 with a magnetically attractable steel bottom 32, a removable insert 34 and a snap on plastic sealing lid 36.

Figure 5:
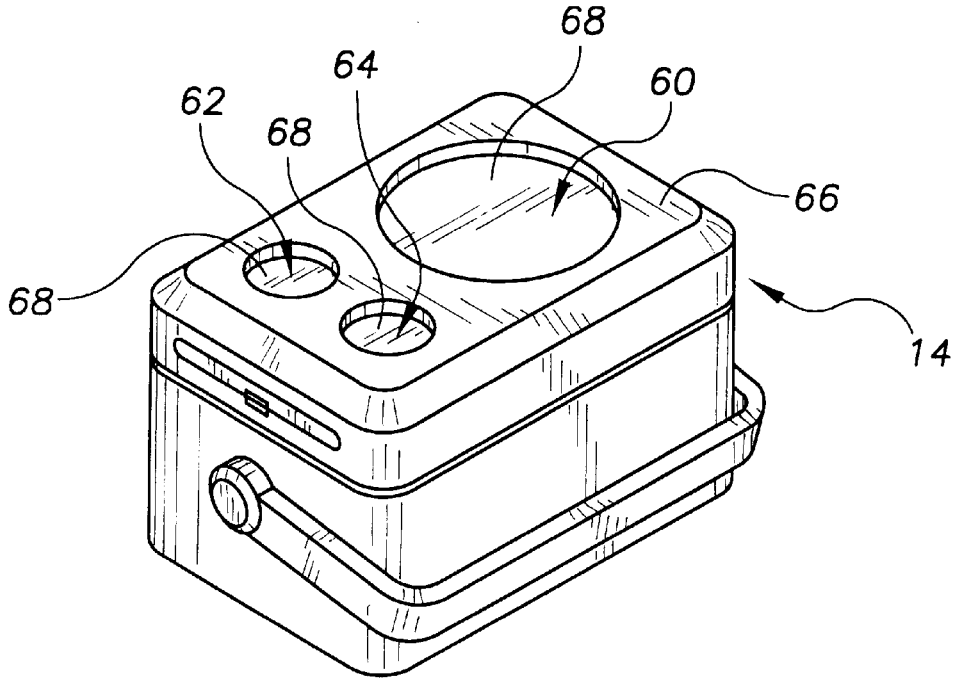
FIG. 5 is a perspective view of lid assembly connected to the lower insulated container structure sealing the food storage compartment.
Figure 6:
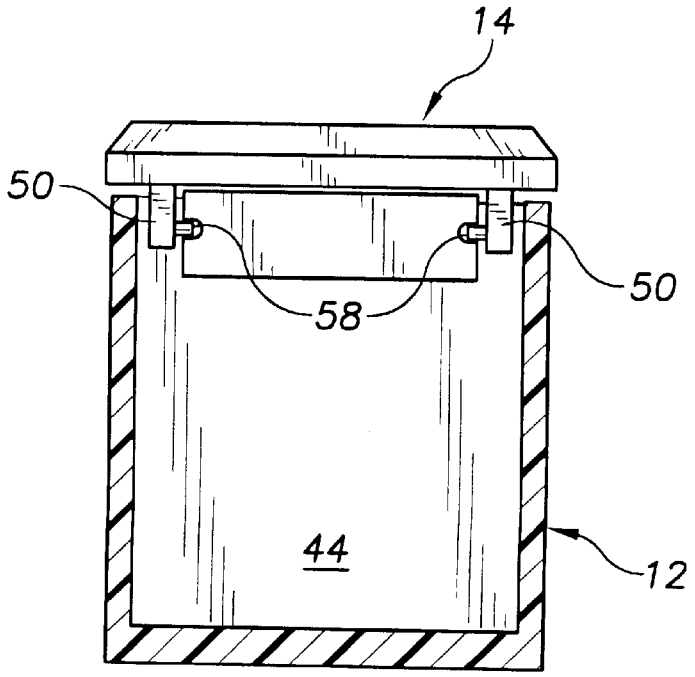
FIG. 6 is plan view of the lower insulated container structure having a sidewall cut away to reveal the food storage compartment; the insulated lid assembly with the bottom portion friction fit into and sealing the top opening of the lower insulated container structure; and the gripping ridge receiving channels of the refreezable ice pack in engagement with the ice pack gripping ridges of the insulated lid assembly.

Referring back to FIG. 1, lower insulated container structure 12 is of molded plastic construction and includes a pivoting handle assembly 40 attached to the exterior 42 thereof and a food storage compartment 44 formed therein accessible through a rectangular top opening 46. Insulated lid assembly 14 is of molded plastic construction and includes a bottom portion 50 (FIG. 6) sized to friction fit into and seal top opening 46 of lower insulated container structure 12, a pull out drink holder 54 that is slidable into a sidewall of the lid assembly 14, referring to FIG. 6, a pair of ice pack gripping ridges 58 depending from bottom portion 50, and, referring to FIG. 5, three container retaining recesses, generally designated 60,62,64, formed into a top lid surface 66. Each retaining recess 60,62,64 is provided with a circular rubberized magnet 68 defining the bottom thereof that operates as a magnetic retaining structure for magnetically holding the bottoms 26,32 of sealable containers 18,20 respectively.

It can be seen from the preceding description that a lunch box system has been provided that includes a lower insulated container structure having a pivoting handle assembly attached to the exterior thereof and a food storage compartment formed therein accessible through a top opening; an insulated lid assembly including a bottom portion sized to friction fit into and seal the top opening of the lower insulated container structure, a pull out drink holder, a pair of ice pack gripping ridges depending from an underside surface thereof, and a container retaining recess formed into a top lid surface thereof, the retaining recess having a magnetic retaining structure provided therein; a refreezable ice pack shaped, sized and provided with gripping ridge receiving channels along opposed side edges thereof such that the refreezable ice pack is slidable into engagement with the ice pack gripping ridges of the insulated lid assembly; and a container having a bottom surface provided with a material to form a magnetic connection with the magnetic retaining structure of the retaining recess such that the container is held in place against a force such as blowing wind etc.

It is noted that the embodiment of the lunch box system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lunch box system comprising:

a lower insulated container structure having a pivoting handle assembly attached to the exterior thereof and a food storage compartment formed therein accessible through a top opening;

an insulated lid assembly including a bottom portion sized to friction fit into and seal the top opening of the lower insulated container structure, a pull out drink holder, a pair of ice pack gripping ridges depending from an underside surface thereof, and a container retaining recess formed into a top lid surface thereof, the retaining recess having a magnetic retaining structure provided therein;

a refreezable ice pack shaped, sized and provided with gripping ridge receiving channels along opposed side edges thereof such that the refreezable ice pack is slidable into engagement with the ice pack gripping ridges of the insulated lid assembly; and a container having a bottom surface provided with a material to form a magnetic connection with the magnetic retaining structure of the retaining recess such that the container tends to be held in place by the magnetic force.

* * * * *